US009431139B2

(12) United States Patent
Teleki

(10) Patent No.: US 9,431,139 B2
(45) Date of Patent: Aug. 30, 2016

(54) METHOD OF UTILIZING NUCLEAR REACTIONS OF NEUTRONS TO PRODUCE PRIMARILY LANTHANIDES AND/OR PLATINUM METALS

(76) Inventor: Péter Teleki, Dunaújváros (HU)

( * ) Notice: Subject to any disclaimer, the term of this patent is extended or adjusted under 35 U.S.C. 154(b) by 578 days.

(21) Appl. No.: 13/699,053

(22) PCT Filed: May 20, 2011

(86) PCT No.: PCT/HU2011/000048
§ 371 (c)(1),
(2), (4) Date: Nov. 29, 2012

(87) PCT Pub. No.: WO2011/144954
PCT Pub. Date: Nov. 24, 2011

(65) Prior Publication Data

US 2013/0070883 A1 Mar. 21, 2013

(30) Foreign Application Priority Data

May 20, 2010 (HU) ..... 1000261

(51) Int. Cl.
*G21G 1/06* (2006.01)

(52) U.S. Cl.
CPC ..... *G21G 1/06* (2013.01)

(58) Field of Classification Search
CPC ..... G21G 1/06
USPC ..... 376/158, 184, 202
See application file for complete search history.

(56) References Cited

U.S. PATENT DOCUMENTS 3,432,386 A * 3/1969 Fitzgerald et al. ..... 376/184
3,591,812 A * 7/1971 Detaint ..... 376/151
6,222,896 B1 4/2001 Jia et al.

(Continued)

FOREIGN PATENT DOCUMENTS

WO 90/06583 A1 6/1990

*Primary Examiner* — Jack W Keith
*Assistant Examiner* — Daniel Wasil
(74) *Attorney, Agent, or Firm* — Jason D. Voight

(57) ABSTRACT

The method according to the invention is accomplished via neutrons produced in a nuclear reactor and moderated to thermal energy level in such a way that a target to be irradiated can also be arranged outside of the reactor shell, within a cassette and/or a container suitable for this purpose. This solution can remarkably increase the production capacity, but can be applied for irradiation channels as well. The disclosure teaches the production of lanthanides and platinum metals, however, other species, e.g. Re, can also be produced. In the technological process the target (mother element) is commercially less valuable than the product (daughter element) prepared therefrom via (n, γ) nuclear reaction. The product—practically the alloy of the mother element and daughter element(s)—can be fully separated into its constituents, element by element, by means of prior art techniques, and can be processed. The thus obtained product, after retention (that is, after normalizing the radiation level), can be made use of. The exemplified daughter elements are Pm, Eu, Tm, Lu; and Rh, Os; and Re. When Os is produced, Re takes the role of the mother element. In certain products other daughter elements also form, such as e.g. Tc, as it is discussed in the specification.

8 Claims, 1 Drawing Sheet

(56) References Cited

U.S. PATENT DOCUMENTS

| | | | | |
|---|---|---|---|---|
| 8,666,015 | B2 * | 3/2014 | Gahl et al. | 376/202 |
| 2002/0156338 | A1 * | 10/2002 | Menuhr et al. | 600/8 |
| 2005/0082469 | A1 | 4/2005 | Carlo | |
| 2009/0213977 | A1 * | 8/2009 | Russell | 376/202 |
| 2009/0274258 | A1 * | 11/2009 | Holden et al. | 376/190 |
| 2010/0061500 | A1 * | 3/2010 | Lou et al. | 376/114 |
| 2011/0305309 | A1 * | 12/2011 | Brown | 376/189 |
| 2012/0121053 | A1 * | 5/2012 | Schenter et al. | 376/158 |

* cited by examiner

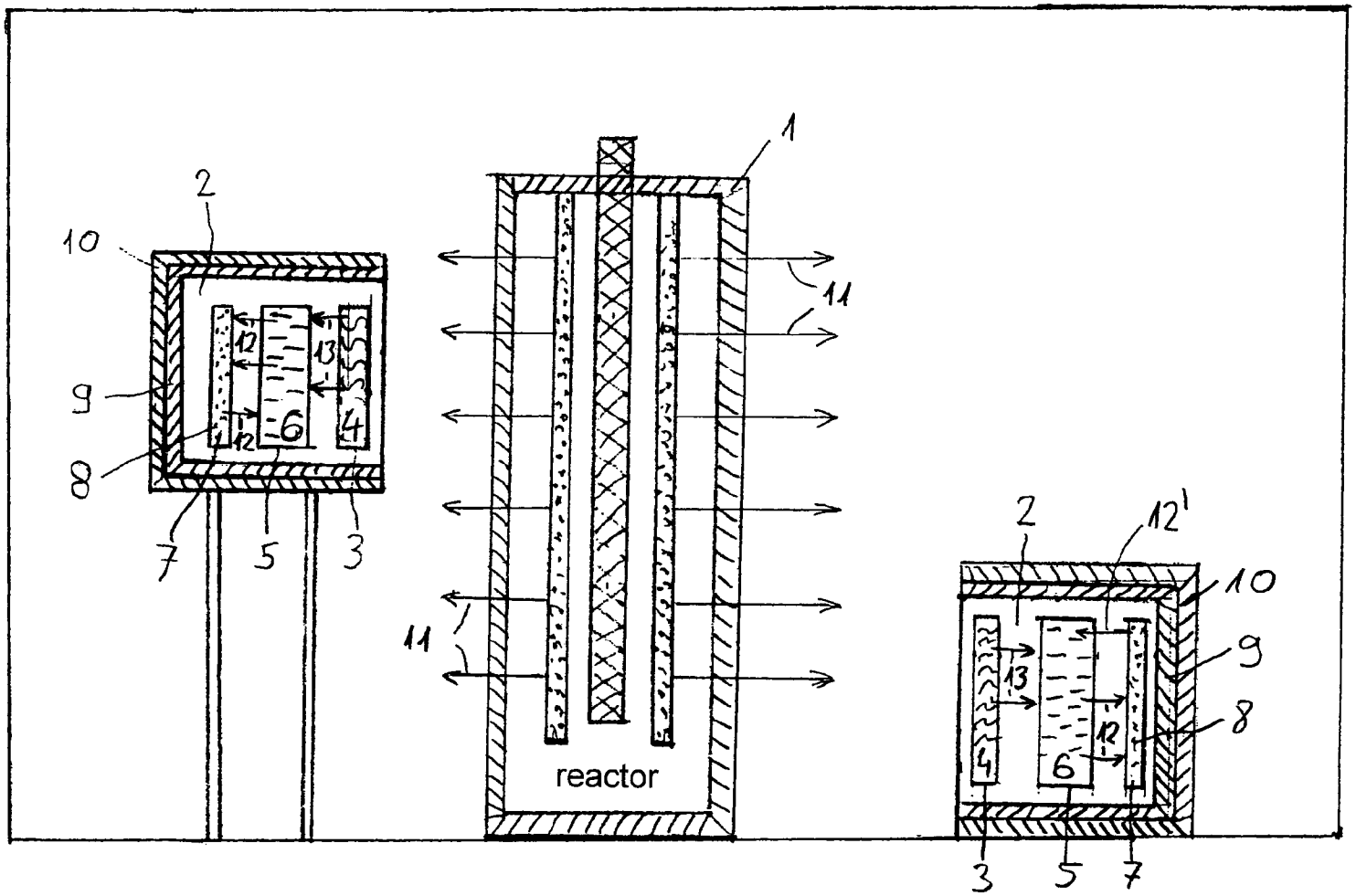
reactor

METHOD OF UTILIZING NUCLEAR REACTIONS OF NEUTRONS TO PRODUCE PRIMARILY LANTHANIDES AND/OR PLATINUM METALS

This is the national stage of International Application PCT/HU2011/000048, filed May 20, 2011.

The inventive concept and the object of the invention are based on the teaching already known from the earlier times, according to which the utilization of nuclear reactors can be augmented with the transmutation of certain elements into other elements of higher value from certain aspects on the industrial scale (i.e. in relatively large amounts).

[Related Hungarian patent application was filed under no. P 88 06077 on 28 Nov. 1988 by Péter Teleki, entitled to "Method of utilizing the (n, γ) reaction of thermal neutrons"; an international patent application was filed under no. PCT/HU89/00054 and entitled to "Method of Utilizing the (n, γ) Reaction of Thermal Neutrons", as well as Canadian Patent no. 2003671 entitled to "Method of Utilizing the (n, γ) Reaction of Thermal Neutrons."]

The above mentioned documents disclose the transmutability of elements Yb and W, such as Yb→Lu, as well as W→Re, wherein the product obtained can be considered as an alloy of at least two components (other daughter elements, e.g. Hf and/or Os, can also form), wherein said product (and also the target) is preferably in the form of a sheet.

To define the invention, the already known details are to be completed hereby in three further aspects.

1. Any lanthanide can be produced from an element located in the periodic system of elements antecedently to it; however, it is of great economical importance of the following type of target(mother element)→product (daughter element) transitions: Nd→Pm, Sm→Eu, Er→Tm, Yb→Lu. Further transitions of elements are also possible, e.g. Gd→Tb, as well as in the case of platinum metals, e.g. Ru→Rh, Re→Os (note: Re is not a platinum metal), as well as W→Re, W→Re→Os.

(These transitions of elements—i.e. transmutations—are, of course, known in the literature and hence, do not form part of the invention, but are parts of the present disclosure.)

2. The physical form of the target(mother element) in the practice is not limited; e.g. powders, as well as metal lumps or granules thereof are equally preferred. It should be here noted that, in general, metal powders are inflammable and hence it is more preferred when they are provided in the form of a carbide, nitride, oxide or silicide.

However, due to the large effective neutron capture cross-section of boron (B), boride variants thereof should not be made use of. Moreover, fluoride and sulphide components should be avoided due to their chemically aggressive nature, nevertheless, they are not forbidden.

The above definition requires no further explanation.

3. A detailed enough disclosure of the specific cassette and/or container (from now on being distinguished from one another) suitable for the arrangement of the target is essential for a complete teaching of the invention; said means—depending on the embodiments considered—can be placed outside of the reactor shell (reactor envelope) and/or within the irradiation channel of the reactor.

The object of the invention is to produce the daughter elements exemplified here on the industrial scale, and also to reach a considerable increase in productivity. A striking example is the position of Os in the global market. Osmium (Os) is the hardest metal on Earth; it is about twice as hard as tungsten (W) and can be used as an alloying element thereof, however, its amount present in global trade is less than 100 kg per year. By the inventive process, an amount of about 1000 kg per year can be produced, per reactor.

Reverting now to the accomplishment of the object of the present invention, in an industrial utilization of nuclear reactors not only the so-called irradiation channels can be exploited but the targets to be irradiated can be deployed directly next to the outer casing of the reactor shell (reactor envelope) which results in a significant increase in the amount of the obtainable product. (See the problem of Os above.)

This solution will affect neither the neutron balance of the reactor nor the other processes taking place within the reactor because the target is located outside of the reactor and the target (mother element)→product (daughter element) transmutation nuclear reactions are effected by the anyway harmful "waste" neutrons.

Naturally, for each type of nuclear reactors there will be zones that are preferential; these zones must be selected from reactor type to reactor type. It is preferred if there is no shielding against neutron radiation between the target and the reactor envelope, said shielding has to be fully deployed behind the whole system of targets. Preferably, but not necessary, there is a neutron thermalizing moderator between the target and the reactor shell that decelerates the neutron shower to a thermal level. To this end, e.g. reactor grade graphite could be advantageously used which can be applied between e.g. aluminum sheets within the cassette already mentioned. The target can also be arranged in a further cassette; then a neutron reflector (mirror) can be arranged from the outside—also within a separate cassette—in which neutrons are scattered back towards the target. This zone is also preferred, but not a requisite, and thus its application is upon discretion.

It is noted that said reflector (mirror) zone, similarly to the moderator zone, can be canned by aluminum, beryllium (Be), as well as PE (polyethylene), if the latter is allowed from the point of view of fire prevention. Therefore, the presumed moderator/target/reflector(mirror) system is located between the reactor shell and the actual radiation shield. It is preferred if the components of this three-component system are arranged in their own separate cassettes because in this way any of the components can be mobilized independently of one another; this is, however, not a requisite. Furthermore, said three-component cassette system can be arranged within a common container provided with extra radiation shielding.

The above technique and embodiment can be made use of in the case of irradiation channels of (research) reactors, as well; here the production batch will be much smaller, however, the product can be prepared in a shorter period of time. As far as budget is concerned, in deployment next to the reactor shell is applied, said "waste" neutrons will do the job free of charge, contrary to the case of the channel-type embodiment which is rather recommended by way of experiment, as well as for smaller production amounts and/or for research purposes.

It is a requirement, however, that any of the mother elements (in any combination and/or composition) specified in the object of the invention are contained by the target in the amount of at least 8.0 weight %. Some possible examples when W is selected are as follows: W90/Ti10, W75/W25, W90/Cr10, W60/Cu40, W90/Ag10, W75/Re25, etc., as well as WC, $WO_3$, $WSi_2$, but—as it was mentioned earlier—$W_2B$ is not recommended, while $WS_2$ is not preferred.

It is noted that if the material of the target also contains moderator and/or reflector(mirror) components, said components should not actually be taken into account as target. The product will be basically a specific alloy, i.e. the mixture of the mother element and the daughter element(s), since these species can be actually alloyed with one another. In the same process, it is also possible to activate the daughter and mother elements further so as to produce secondary daughter elements, such as e.g. by the process of W→Re→Os, as will be discussed later in more detail.

Reverting now to a detailed description of the cassettes, in the case of the irradiation channel construction, the important factor is apparently the inner diameter of the channel which is, in general, about 10 cm in size. In the case of the reactor shell, an embodiment of the cassette type with a base plate of e.g. 90 by 90 cm in size is preferred, however, this represents only a possible example. The base material of said cassettes can be Mg, Al, Fe, Zr, as well as any suitable alloys thereof. The cassettes can be grouped in three, such as moderator/target/reflector(mirror), wherein each group (cassette) is separated from the others. It is highly preferred if the respective cassette of the target can be taken out separately from amongst the two others. Separate displaceability of the target cassette is also preferred, as the moderator cassette and/or the reflector cassette have to be displaced much rarely. Apparently, the displacement of said cassettes is performed by robots and manipulators.

In what follows, the cassette types and the container are discussed in more detail.

(a) The moderator cassette is mostly determined by the neutron spectrum and flux of the reactor. It is an object to provide a thermal reactor neutron yield that is maximal at the exit side of said cassette. It is noted that most reactor types produce enough thermal neutrons to activate the target without even a moderator, however, this is a slower process. The moderator can be provided by reactor grade C graphite, $H_2O$, $D_2O$, paraffin and He. When paraffin is used, to moderate fast neutrons and (reactor) neutrons a thickness of about 40 cm and about 20 cm, respectively, thereof is required. For C graphite, the thickness should be about 10 cm (this is considered to be the most advantageous).

(b) The target cassette is filled up with one of the (perhaps more) mother elements mentioned before. When selecting the material thickness, self-absorption of the target element(s) and that of the resultant daughter element(s) have to be taken into account. Thus, the recommended material thickness ranges preferably from 10 to 15 cm. It is preferred to form the cassette with a net volume of 100 $dm^3$. Depending on its filling, the cassette has a gross mass of 2 to 4 tons.

(c) The reflector(mirror) cassette is constructed with similar principles in mind; however, the backscattering of neutrons has to be considered with a thermal value. The usage of Be is preferred, but due to its intoxicating nature, rather BeO is recommended. Due to its hydrogen content, PE is a scatter medium, however, it is not heat-resistant. Mainly Ni and Fe, as well as any suitable alloys thereof, and/or Bi, Pb (not preferred too much), $Bi_2O_3$ which is stable, heat-resistant and chemical resistant enough can be offered, too.

(d) The (three-component) cassette supporter container, as is also reflected by its name, is a means suitable for holding the three cassettes together. As far as its base material is concerned, it is identical to those of the cassettes. Moreover, it is mechanically designed so as to withstand to chemical, thermal and mechanical damages and also to be less activable as structural material. It is also equipped with suitable means and elements for effecting displacements and connections. Its dimensions are preferentially about 90 by 90 by 60 cm; this corresponds well to the sizes expressed in units of inches well-spread and used in the international practice. Except its side facing to the reactor (i.e. the front side), said container can be provided with extra radiation shield. The gross mass of the container with the cassettes is about 8 to 10 tons.

It is noted that in the case of the irradiation channel the situation is simpler: the thermal neutron flux can be affected ab ovo by means of the built-in filtering means of the reactor. Hence, it is not sure that there is a need for the moderator cassette, which is apparently a cylindrical casing, in this case. The construction in principle follows that of the system with cassettes, however, as here there are provided means of much smaller weight, the base material of the casing can be Al and/or Fe. The length of said cylindrical casing corresponds to the width of said cassettes. This means that preferably and purposively each casing is 10 to 20 cm in length. Since in this case there is no need for the container support, a radial shield cassette can also be arranged after said reflector(mirror) cassette as a fourth component.

In what follows, the present invention is overviewed with reference to the FIGURE.

I. (Reactor)neutrons 11 leaving through the reactor shell 1 passes over the front side of container 2 and then enter the moderator cassette 3 containing suitably chosen moderator substance 4. From here they proceed with a maximal thermal neutron yield 13 and enter the target cassette 5, and the target 6 mother element. The remaining thermal neutrons 12 pass further and enter the reflector(mirror) cassette 7 containing suitably chosen reflector(mirror) substance 8 that scatters part of the thermal neutrons 12 entering here back towards the target 6. The container 2 itself, except its front portion, is equipped with extra radiation shield 9 which is protected by an outer envelope 10 that is preferably based on Fe.

II. The irradiation channel requires no further explanation.

Reverting now to the prior art techniques and technology, the excellent work of C. Rubbia (PCT/EP97/03218, filed on 19 Jun. 1997.) should be here also mentioned, which exploits neutrons escaping from a reactor, but makes use of other neutron sources as well. This is preferred mainly when existing radioactive (power plant) wastes are to be activated further so as to transmute them into elements of lower half-lives. The author also discloses—amongst others—the producibleness of various (medical) isotopes, the doping of Si and Ge based elements with impurities, etc. It is essential, however, that the transformation (transmutation) of lanthanides and platinum metals is not mentioned amongst the objectives of the invention. Although the author has constructed a table collecting all the elements and their isotopes from Na to Th which could be produced by the apparatus of the author, said apparatus is not descriptive—and, hence, is not meritorious—to the system comprising cassettes and a container in accordance with the subject-matter of present invention as disclosed here.

Reverting now, with reference to some highlighted examples, to the major radiation physics features of transmutation (element transformation) according to the present invention, said examples are numbered in harmony with the tables, wherein the signals "a", "c" and "e" always refer to mother elements, while the signals "b", "d" and "f" refer to daughter elements, except the case of Re that can be both a mother and a daughter element (see later), i.e. the transformation process of mother element→daughter element is referred to e.g. by the notation of "a→b".

The atomic number in front of the chemical symbol of a given element, possible isotopes of the element (below said symbol) and the natural abundance ratios thereof within said element in % units, the thermal neutron capture cross-section of each isotope in barn units (rounded values), the half-life (T½) of each isotope, and the types of radiation characteristic of the isotopes are also given (α, e±, γ, K; here K stands for the characteristic radiation, wherein various types of electron irradiations are denoted in a unique form. The state also determines the way of decay, i.e. the mother element transforms into an other element having its atomic number decreased by one). The so-called nuclear isomers are also denoted by the label "m".

Neodymium→Promethium wherein Promethium has got no stable isotopes

TABLE 1a

| | % | barn | half-life (T½) | radiation |
|---|---|---|---|---|
| 60Nd | | 48 | | |
| 142 | 27.11 | 18 | | |
| 143 | 12.17 | 240 | | |
| 144 | 23.85 | 5 | $1*10^{15}$ years | α |
| 145 | 8.30 | 60 | | |
| 146 | 17.22 | 2 | | |
| 147 | | | 11.0 days | $e^-$ γ |
| 148 | 5.73 | 4 | | |
| 149 | | | 1.8 hours | $e^-$ γ |
| 150 | 5.62 | 2 | | |
| 151 | | | 12.0 minutes | $e^-$ γ |

Note:
natural Nd also contains an α-radiator; similar elements are Sm, Gd, Hf, Pt, Pb, Th and U.

During the transmutation, Nd144 becomes remarkably enriched (as Nd143 isotope has got high neutron-capture cross-section) and Pm isotopes will form.

TABLE 1b

| | % | barn | half-life (T½) | radiation |
|---|---|---|---|---|
| 61Pm | | 60 | | |
| 147 | | | 2.6 years | $e^-$ |
| 149 | | | 53.0 hours | $e^-$ γ |
| 151 | | | 1.1 days | $e^-$ γ |

The transmutation reactions, in principle, are the following:

a, Nd147→Pm147→Sm147→Eu147.

b, Nd149→Pm149→Sm149.

c, Nd151→→Pm151→Sm151→Eu151.

From this, in practice Pm147 can be utilized, which is pure $e^-$-radiator (0.225 MeV) and will "stabilize" as 62Sm147 which is pure α-radiator with the half-life of $1.2*10^{11}$ years (2.23 MeV). Here, the product can be enriched in Nd147/Pm147 isotopes to an extent of about 10% to 15%.

Samarium→Europium

TABLE 2a

| | % | barn | half-life (T½) | radiation |
|---|---|---|---|---|
| 62Sm | | 5820 | | |
| 144 | 3.09 | 2 | | |

TABLE 2a-continued

| | % | barn | half-life (T½) | radiation |
|---|---|---|---|---|
| 145 | | | 340.0 days | γ K |
| 146 | | | $5*10^7$ years | α |
| 147 | 14.97 | 87 | $1*10^{10}$ years | α |
| 148 | 11.24 | | | |
| 149 | 13.83 | 40810 | | |
| 150 | 7.44 | | | |
| 151 | | 14000 | 93.0 years | $e^-$ γ |
| 152 | 26.72 | 140 | | |
| 153 | | | 47.0 hours | $e^-$ γ |
| 154 | 22.71 | 5 | | |
| 155 | | | 23.5 minutes | $e^-$ γ |
| 156 | | | | |

Due to its very high neutron-capture cross-section, Sm151 will be activated further, and thus the formation of Eu151 is not characteristic; it is thought that Eu153 will become enriched within the Sm153 target and/or the transmutation of Eu155-64Gd155 can be detected from Sm155 in traces.

TABLE 2b

| | % | barn | half-life (T½) | radiation |
|---|---|---|---|---|
| 63Eu | | 4400 | | |
| 151 | 47.82 | 1700 | | |
| 152m | | | 9.2 hours | e± K |
| 152 | | 6200 | 12.2 years | e± γ K |
| 153 | 52.18 | 440 | | |
| 154 | | 1690 | 16.0 years | $e^-$ γ |
| 155 | | 15800 | 1.7 years | $e^-$ γ |

The isomer state of Eu152m will finally stabilize as 64Gd152. Altogether, the Sm153→Eu153 product state can be selected along with an Eu concentration of about 20% to 25%.

The transmutation reactions, in principle, are the following:

a, Sm145→Pm145→Nd145. (As Sm145 undergoes K-decay.)

b, Sm151→Eu151.

c, Sm153→Eu153.

d, Sm155→Eu155→Gd155.

Erbium→Thulium

TABLE 3a

| | % | barn | half-life (T½) | radiation |
|---|---|---|---|---|
| 68Er | | 160 | | |
| 162 | 0.13 | 2 | | |
| 163 | | | 75 minutes | γ K |
| 164 | 1.56 | 2 | | |
| 165 | | | 10 hours | γ K |
| 166 | 33.41 | | | |
| 167m | | | 2.5 seconds | γ |
| 167 | 22.90 | | | |
| 168 | 27.07 | 2 | | |
| 169 | | | 9.5 days | $e^-$ γ |
| 170 | 14.88 | 9 | | |
| 171 | | | 7.8 hours | $e^-$ γ |

Due to the K-radiation of Er, only Ho can form in an Erbium target up to Er165. The range of Er166 to Er168 is favorable for us; here the Er168 isotope will become remarkably enriched that slightly compensates for the low cross-section (in barns).

TABLE 3b

| | % | barn | half-life (T½) | radiation |
|---|---|---|---|---|
| 167 | | | 9.6 days | γ K |
| 168 | | | 87.0 days | $e^-$ γ K |
| 69Tm | | 130 | | |
| 169 | 100.00 | 130 | | |
| 170 | | 170 | 129.0 days | $e^-$ γ K |
| 171 | | | 1.9 years | $e^-$ γ |

Altogether, in the transmutation process of Er169→Tm169 even 50% of Er can transform into the state of Tm 169. Ho and Yb will appear in the alloy in a few %.

The transmutation reactions, in principle, are the following:

a, Er163→Ho163→Dy163.

b, Er165→Ho165→Ho165.

c, Er169→Tm169.

d, Er171→Tm171→Yb171.

Ytterbium→Lutetium

It should be here noted that this process has already been discussed in the patent document cited previously, and hence the following serves merely as a reminder.

TABLE 4a

| | % | barn | half-life (T½) | radiation |
|---|---|---|---|---|
| 70Yb | | 37 | | |
| 168 | 0.13 | 12400 | | |
| 169$^m$ | | | 46.0 seconds | γ |
| 169 | | | 31.8 days | γ K |
| 170 | 3.03 | | | |
| 171 | 14.31 | | | |
| 172 | 21.82 | | | |
| 173 | 16.13 | | | |
| 174 | 31.84 | 60 | | |
| 175$^m$ | | | 0.0 seconds | γ |
| 175 | | | 101.0 hours | $e^-$ γ |
| 176 | 12.73 | | | |
| 177$^m$ | | | 6.5 seconds | γ |
| 177 | | | 1.9 hours | $e^-$ γ |

The stabilizing process of Yb169$^m$→169 leads to Tm169; this process is a direct consequence of the high cross-section value (in barns) of Yb168 and K-decay of Yb169.

Lu can form if the process of Yb175$^m$→175 takes place; the formation of other Yb isotopes is not probable.

TABLE 4b

| | % | barn | half-life (T½) | radiation |
|---|---|---|---|---|
| 174$^m$ | | | 90.0 days | γ |
| 174 | | | 163.0 days | γ K |
| 71Lu | | 108 | | |
| 175 | 97.40 | 35 | | |
| 176$^m$ | | | 37 hours | $e^-$ γ |
| 176 | 2.60 | 4000 | $2*10^{10}$ years | $e^-$ γ |
| 177 | | | 6.7 days | $e^-$ γ |

In the alloy of the product, Lu can become enriched up to at least 50%; the impurities can be Tm and Hf.

The theoretical transmutation reactions are the following:

a, Yb169→Tm169.

b, Yb175→Lu175.

c, Yb177→Lu 177→Hf177.

Note: besides the above exemplified reaction processes, it is also possible to produce other lanthanides as well, see e.g. the already mentioned Gd→Tb element transmutation.

Hence, as it is already known:

Tungsten→Rhenium

TABLE 5a

| | % | barn | half-life (T½) | radiation |
|---|---|---|---|---|
| 75W | | 18 | | |
| 180 | 0.13 | 10 | | |
| 181 | | | 145 days | γ K |
| 182 | 26.41 | 20 | | |
| 183$^m$ | | | 5.3 seconds | γ |
| 183 | 14.40 | 11 | | |
| 184 | 30.64 | 2 | | |
| 185$^m$ | | | 1.6 minutes | γ |
| 185 | | | 73.2 days | $e^-$ γ |
| 186 | 26.41 | 34 | | |
| 187 | | 90 | 1.0 days | $e^-$ γ |

W184 becomes enriched in the activation process, however, the transmutation process of W185→Re185 undergoes with low efficiency; on the contrary, the process of W187→Re187 is much favorable.

Due to the K-decay of W181, Ta contamination forms; moreover, as a consequence of Os188$^m$→Os188, the rhenium daughter element will contain Os188.

TABLE 5b

| | % | barn | half-life (T½) | radiation |
|---|---|---|---|---|
| 75 Re | | 84 | | |
| 185 | 37.07 | 120 | | |
| 186$^m$ | | | 1.0 hours | γ |
| 186 | | | 88.9 hours | $e^-$ γ K |
| 187 | 62.93 | 69 | $6*10^{10}$ years | $e^-$ |
| 188$^m$ | | | 18.7 minutes | γ |
| 188 | | 2 | 18.0 hours | $e^-$ γ |

It should be here noted that the $e^-$-emission of Re187 is very low both in intensity and in energy.

The theoretical transmutation reactions are the following:

a, W181→Ta181.

b, W185→Re185.

c, W187→Re187.

If the object is to produce Os, tungsten can be activated further:

W→Re→Os (in harmony with the interpretation of 5a→5b→6b)

This process is extremely advantageous and economical in the case of the reactor shell type technologies.

As it was already mentioned, the Ta181 component will appear in the product in a minimal amount, the major part of rhenium will be Re187 isotope, while the osmium is typically formed by Os188. (This latter can form as much as 10% to 20% of the product.)

Osmium can be produced from natural rhenium itself in a more efficient way:

Rhenium→Osmium

See Process 6a→6b Below

TABLE 6b

| | % | barn | half-life (T½) | radiation |
|---|---|---|---|---|
| 76Os | | 15 | | |
| 184 | 0.02 | 200 | | |

TABLE 6b-continued

| | % | barn | half-life (T½) | radiation |
|---|---|---|---|---|
| 185 | | | 93.6 days | γ K |
| 186 | 1.59 | | | |
| 187 | 1.64 | | | |
| 188$^m$ | | | 26.0 days | γ |
| 188 | 13.30 | | | |
| 189$^m$ | | | 5.7 hours | γ |
| 189 | 16.10 | | | |
| 190$^m$ | | | 10.0 minutes | γ |
| 190 | 26.40 | 40 | | |
| 191$^m$ | | | 14.0 hours | γ |
| 191 | | 8 | 16.0 days | $e^-$ γ |
| 192 | 40.95 | 2 | | |
| 193 | | 600 | 30.6 hours | $e^-$ γ |
| 194 | | | 1.9 years | $e^-$ |

The activation of Re185 into Re186$^m$-186 will stabilize by $e^-$- and K-decays as W186 and Os186 isotopes in such a way that the Os portion will be higher. (That is, the initial amount of 1.59% of Os186 increases.)

The theoretical transmutation reactions are the following:

a, Re186→Os186+W186.

b, Re188→Os188.

There is no Os185 within the product; other parts of the spectrum are of extremely low intensity. Within the product, Ir can also be present in traces.

It is mentioned here that the most valuable stable isotope of natural Os is Os 187 that forms 1.64% of natural Os. The osmium product obtained by the inventive process is a mixture of isotopes Os186 and Os188 and isotopes Re185 and Re187. In what follows two different ways are offered to produce the isotope Os187 from this:

(a) in the (n, 2n) reaction of reactor neutrons, the cross-section of Os186 is 0.04 barn, while that of Os188 is 0.005 barn.

(Hence, Os188 can transform into Os187, while Os186 remains also a stable isotope. A portion of Re stabilizes as W, a further portion thereof stabilizes as Os186.)

(b) by means of intermediary resonance neutrons with energies ranging from 1 eV to 100 keV, the processes of Os186→Os187 and Os188→Os189$^m$→Os189 can be induced; here the state of Re barely changes. The Os isotopes forming here can be separated only by means of complicated separation techniques in any variants.

Amongst the platinum metals, producibility of rhodium is going to be discussed in more detail; it is, however, apparent to a person skilled in the art that, besides the elements disclosed previously, it is possible to produce other elements as well.

Ruthenium→Rhodium

TABLE 7a

| | % | barn | half-life (T½) | radiation |
|---|---|---|---|---|
| 44Ru | | 3 | | |
| 96 | 5.53 | 1 | | |
| 97 | | | 2.9 days | γ K |
| 98 | 1.87 | | | |
| 99 | 12.72 | | | |
| 100 | 12.62 | | | |
| 101 | 17.07 | | | |
| 102 | 31.61 | 1 | | |
| 103 | | | 39.7 days | $e^-$ γ |
| 104 | 18.58 | 1 | | |
| 105 | | 1 | 4.51 hours | $e^-$ γ |

TABLE 7b

| | % | barn | half-life (T½) | radiation |
|---|---|---|---|---|
| 45Rh | | 150 | | |
| 103$^m$ | | | 57.0 minutes | γ |
| 103 | 100.00 | 149 | | |
| 104$^m$ | | 900 | 4.4 minutes | γ |
| 104 | | 45 | 42.0 seconds | $e^-$ γ |
| 105$^m$ | | | 45.0 seconds | γ |
| 105 | | | 35.0 hours | $e^-$ γ |
| 106$^m$ | | | 2.2 hours | $e^-$ γ |
| 106 | | | 30.0 seconds | $e^-$ γ |

The activation of ruthenium takes place with quite low efficiency. Via K-decaying, Ru97 goes into the state of Tc97$^m$→Tc97, which is a K-radiator isotope with a long half-life (2.6*10$^6$ years).

The theoretical transmutation reactions are the following:

Ru102(n,γ)→Ru103→Rh103$^m$→Rh103.

Rh can be easily activated, and thus Tc and Pd contaminants/alloying elements form in the product besides the Ru—Rh alloy.

Considering the fact that the products are radioactive, in what follows the energy of the gamma spectrum (MeV) and the specific irradiation power kγ (in relative values) are also given for those isotopes, wherein the number of γ quanta exceeds 10 per 100 decays.

Here, the mother element→daughter element transformation reactions are referred to by the label of the type "c→d".

For the various elements, the radiation characteristics and parameters are the following:

| TABLE 1c | | | | TABLE 1d | | |
|---|---|---|---|---|---|---|
| Nd | MeV | kγ | → | Pm | MeV | kγ |
| 144 | 0.09 | 0.8 | | 151 | 0.06 | 0.7 |
| | 0.53 | | | | 0.10 | |
| 151 | 0.11 | 3.3 | | | | |
| | 0.12 | | | | | |
| | 0.14 | | | | | |
| | 0.25 | | | | | |

| TABLE 2c | | | | TABLE 2d | | |
|---|---|---|---|---|---|---|
| Sm | MeV | kγ | → | Eu | MeV | kγ |
| 145 | 0.06 | 0.0 | | 152$^m$ | 0.12 | 1.3 |
| | | | | | 0.85 | |
| 153 | 0.10 | 0.2 | | | | |
| | | | | 152 | 0.12 | 5.0 |
| 155 | 0.10 | 0.4 | | | | |
| | | | | 154 | 0.12 | 6.2 |
| | | | | | 0.73 | |
| | | | | | 0.87 | |
| | | | | | 1.00 | |
| | | | | | 1.01 | |
| | | | | | 1.28 | |
| | | | | 155 | 0.06 | 0.8 |
| | | | | | 0.08 | |
| | | | | | 0.10 | |
| | | | | | 0.12 | |

| TABLE 3c | | | | TABLE 3d | | |
|---|---|---|---|---|---|---|
| Er | MeV | kγ | → | Tm | MeV | kγ |
| 167m | 0.21 | 0.5 | | | | |
| 171 | 0.11 | 1.8 | | | | |
| | 0.30 | | | | | |
| | 0.31 | | | | | |

There is no remarkable γ radiation from Tm in the product.

| TABLE 4c | | | | TABLE 4d | | |
|---|---|---|---|---|---|---|
| Yb | MeV | kγ | → | Lu | MeV | kγ |
| 169 | 0.06 | 1.2 | | 176 | 0.20 | 2.7 |
| | 0.11 | | | | 0.30 | |
| | 0.13 | | | | | |
| | 0.18 | | | | | |
| | 0.20 | | | | | |
| | 0.31 | | | | | |
| 177 | 0.12 | 0.4 | | | | |

| TABLE 5c | | | | TABLE 5d | | |
|---|---|---|---|---|---|---|
| W | MeV | kγ | → | Re | MeV | kγ |
| 183m | 0.10 | 0.5 | | 186 | 0.14 | 0.1 |
| | 0.11 | | | | | |
| | 0.16 | | | 188 | 0.15 | 0.4 |
| 187 | 0.07 | 2.8 | | | | |
| | 0.48 | | | | | |
| | 0.68 | | | | | |

| TABLE 5a, 5b! | | | | TABLE 6d | | |
|---|---|---|---|---|---|---|
| Re | MeV | kγ | → | Os | MeV | kγ |
| 186 | 0.14 | 0.1 | | 185 | 0.64 | 4.1 |
| 188 | 0.15 | 0.4 | | | | |

| TABLE 7c | | | | TABLE 7d | | |
|---|---|---|---|---|---|---|
| Ru | MeV | kγ | → | Rh | MeV | kγ |
| 103 | 0.50 | 1.2 | | 104m | 0.05 | 1.0 |
| 105 | 0.67 | 3.9 | | 105m | 0.13 | 0.1 |
| | 0.72 | | | | | |
| | | | | 106m | 0.22 | 13.4 |
| | | | | | 0.41 | |
| | | | | | 0.45 | |
| | | | | | 0.51 | |
| | | | | | 0.62 | |
| | | | | | 0.72 | |
| | | | | | 0.74 | |
| | | | | | 0.82 | |
| | | | | | 1.05 | |
| | | | | | 1.14 | |
| | | | | | 1.22 | |
| | | | | | 1.54 | |

A possible and well-known technique to separate the mother and daughter elements of the product is to keep the product in a molten phase by means of maintaining it at the requisite temperature until the element components get separated from one another, driven by gravity, due to the difference in their densities. If the product is a powder, it can be oxidized; in particular lanthanides are stable in the forms of $LaF_3$ and $La_2O_3$, wherein the latter oxidized form is recommended.

(Preferably, the crucible is provided by a vertical ceramic tube, the inner surface of which is coated with any of $AL_2O_3$, Ta, W and Ir according to needs. For oxide melts, the most preferred is Ir, while for metallic melts Ta and W are recommended.)

Processing of the products seems to be the simplest in the oxidized form.

(Note: B.P.=Boiling Point,
M.P=Melting Point,
D.=Density)

Here, the mother element→daughter element transformation reactions are referred to by the label of the type "e→f".

| | | | | |
|---|---|---|---|---|
| Nd | → Pm | ; | Sm | → Eu |
| B.P.: 3068 | ? | | 1791 | 1597 |
| M.P.: 1021 | 1027 | | 1077 | 822 |
| D.: 7.00 | ? | | 7.54 | 5.24 |
| $Nd_2O_3$ | → $Pm_2O_3$ | | $Sm_2O_3$ | → $Eu_2O_3$ |
| M.P.: 2272 | ? | | 2350 | 2056 |
| D.: 7.24 | ? | | 7.43 | 8.18 |
| Table 1e | Table 1f | | Table 2e | Table 2f |

| | | | | |
|---|---|---|---|---|
| Er | → Tm | ; | Yb | → Lu |
| B.P.: 2863 | 1947 | | 1194 | 3395 |
| M.P.: 1529 | 1545 | | 819 | 1663 |
| D.: 9.05 | 9.32 | | 6.98 | 9.84 |
| $Er_2O_3$ | → $Tm_2O_3$ | | $Yb_2O_3$ | → $Lu_2O_3$ |
| M.P.: 2400 | instable | | 2346 | instable |
| D.: 8.64 | 8.90 | | 9.17 | 9.41 |
| Table 3e | Table 3f | | Table 4e | Table 4f |

| | | | | |
|---|---|---|---|---|
| W | → Re | ; | Re | → Os |
| B.P.: 5660 | 5627 | | 5627 | 5027 |
| M.P.: 3410 | 3180 | | 3180 | 3045 |
| D.: 19.3 | 21.0 | | 21.0 | 22.5 |
| W $O_3$ | $Re_2O_7$ | | $Re_2O_7$ | $Os_2O_3$ |
| M.P.: 1473 | 297 | | 297 | instable |
| D.: 7.16 | 8.20 | | 8.20 | ? |
| Table 5e | Table 5f | | 5f ! Table 6e | Table 6f |

Thus, the Os isotopes of the product will basically consist of merely Os186 and Os188 isotopes.

To separate the mother and daughter elements of the product, the same technique is recommended as in the case of the lanthanides:

| | | |
|---|---|---|
| Ru | → | Rh |
| B.P.: 3900 | | 3727 |
| M.P.: 2310 | | 1965 |
| D.: 12.20 | | 12.40 |
| Table 7e | | Table 7f |

Oxidized forms thereof (in practice) are not known.

It should be here noted that the neutron-capture cross-section of the daughter element Rh forming in the process Ru→Rh is much higher than that of the mother element Ru. Consequently, it decays further upon activation, wherein the half-lives of said decays are relatively short. Taken the decay and forming factors of the mother and daughter element(s), as well as the activation time and the half-lives also into account, there will be no daughter element Rh present in the product if the concentration of Ru within the target does not exceed the value of at least 8 weight %, since the target cannot be transmuted into Rh even if it contains 100% Ru. Namely, upon reaching a so-called radioactive decay balance, the activity of the daughter element is at maximum and hence further activation of the mother element is no longer preferred which means that there will always be mother elements that have undergone no transmutation. (This statement is even more relevant when Os187 is produced.)

Briefly summarized: the teaching related to the production process of the products discussed here is considered to be a proof of applicability of the present invention in practice. The technology based on the utilization of a "cassette—container plus reactor shell" type arrangement illustrated above enables a significant industrial increase. This increase will induce further changes in those industrial segments as well where the inventive solution becomes applied thereby affecting/changing the future of these segments, too.

LITERATURE

Jász Árpád-Lengyel Tamás: Izotóplaboratóriumi zsebkönyv Müiszaki Könyvkiadó 1966.

Neutron Cross section—Brookheaven National Laboratory, 2nd edition 1958.

S. F Mughabghab et al. Neutron Cross section: Neutron Resonance Parameters and Thermal Cross Section v.1 (Neutron Cross sections Series) (Vol1) Saunders College Publishing Nuclear Fission and Neutron-included Fission Cross-section (Neutron physics and nuclear data in science and technology), Pergamon Press 1981

Atlas of Neutron Resonances, 5th edition: Resonance Parameters and Thermal Cross Sections. Z=1-100 S. F. Mughabghab, Elsevier Science (5th edition 2006)

The invention claimed is:

1. A method of utilizing nuclear reactions of neutrons in a target to produce primarily lanthanides in said target on an industrial scale, said method comprising the steps of providing the target comprising any of Nd, Sm, Gd, Er, or Yb in any combination and/or composition thereof as mother element, wherein said mother element is contained in said target in an amount of at least 8.0 weight%;

arranging said target within a container;

arranging said container outside of a shell of a nuclear reactor with an active core;

irradiating the target arranged within the container with neutrons generated in the active core of said nuclear reactor along with keeping the container outside of the shell throughout the irradiation, wherein said irradiating generates (n, γ) nuclear reactions involving the mother element, and producing lanthanides as daughter elements via said nuclear reactions, wherein a neutron moderator substance is arranged within the container between the shell of the nuclear reactor and the target, and a neutron backscattering reflector substance is arranged within the container behind the target, and the target is contained in a target cassette with a net volume of about 100 $dm^3$ and a gross mass of 2 to 4 tons depending on the mother element used in the target, and said container is prepared with the dimensions of about 90 by 90 by 60 cm and has a gross mass of about 8 to 10 tons when assembled and ready to be irradiated;

after irradiating, displacing at least said target cassette from the outside of the shell of the nuclear reactor to recover the lanthanides produced.

2. The method of claim 1, further comprising arranging at least one of the neutron moderator substance and the neutron backscattering reflector substance in a respective separate cassette having a base plate with the dimensions of about 90 cm by 90 cm.

3. The method of claim 1, further comprising providing the mother element in the target in a form selected from the group consisting of powders, granulates, metallic lumps, bars and sheets.

4. The method of claim 1, further comprising providing the mother element in the target in a state selected from the group consisting of compounds, solutions, ceramics and amorphous states.

5. The method of claim 1, further comprising providing the mother element in the target as a carbide, nitride, oxide or silicide.

6. The method of claim 2, further comprising the step of displacing only the target cassette from the outside of the shell of the nuclear reactor and leaving any of the cassettes containing the neutron moderator substance or the neutron backscattering reflector substance in place for several irradiation periods.

7. The method of claim 1, further comprising the step of arranging a radiation shield within the container to decrease emission to the outside of the container.

8. The method of claim 1, further comprising altering an isotope composition of a daughter element obtained from the mother element via (n, γ) nuclear reactions of intermediary resonance neutrons generated in the active core of said nuclear reactor.

* * * * *